US007868841B2

(12) United States Patent
Pettus

(10) Patent No.: US 7,868,841 B2
(45) Date of Patent: Jan. 11, 2011

(54) FULL-WAVE DI-PATCH ANTENNA

(75) Inventor: Michael Gregory Pettus, Dana Point, CA (US)

(73) Assignee: Vubiq Incorporated, Aliso Viejo, CA (US)

( * ) Notice: Subject to any disclaimer, the term of this patent is extended or adjusted under 35 U.S.C. 154(b) by 785 days.

(21) Appl. No.: 11/786,761

(22) Filed: Apr. 11, 2007

(65) Prior Publication Data

US 2008/0252543 A1 Oct. 16, 2008

(51) Int. Cl.
*H01Q 9/16* (2006.01)

(52) U.S. Cl. ..... 343/793

(58) Field of Classification Search ..... 343/793, 343/700 MS, 702, 754–755; 340/572.7
See application file for complete search history.

(56) References Cited

U.S. PATENT DOCUMENTS

| | | | | |
|---|---|---|---|---|
| 5,903,239 | A | 5/1999 | Takahashi et al. | |
| 6,313,801 | B1 | 11/2001 | Sanford et al. | |
| 6,320,509 | B1 | 11/2001 | Brady et al. | |
| 7,042,413 | B2 * | 5/2006 | Mazoki et al. | 343/795 |
| 7,084,815 | B2 | 8/2006 | Phillips et al. | |
| 7,394,438 | B2 * | 7/2008 | Forster et al. | 343/806 |
| 7,501,955 | B2 * | 3/2009 | Forster et al. | 340/572.7 |
| 7,633,445 | B2 * | 12/2009 | Yamagajo et al. | 343/700 MS |
| 7,652,636 | B2 * | 1/2010 | Forster et al. | 343/860 |
| 2002/0067315 | A1 | 6/2002 | Kunysz | |
| 2005/0104789 | A1 | 5/2005 | Hiashidate et al. | |
| 2005/0259030 | A1 | 11/2005 | Mizuno et al. | |
| 2006/0038725 | A1 | 2/2006 | Tikhov et al. | |
| 2006/0044192 | A1 | 3/2006 | Egbert | |
| 2006/0109177 | A1 | 5/2006 | Prieto-Burgos et al. | |
| 2006/0208900 | A1 | 9/2006 | Tavassoli Hozouri | |

FOREIGN PATENT DOCUMENTS

| | | | |
|---|---|---|---|
| EP | 0493014 | A1 | 7/1992 |

OTHER PUBLICATIONS

Aoki, et al. "A Flip Chip Bonding Technology Using Gold Pillars for Millimeter-Wave Applications" 1997 IEEE MTT-S Digest pp. 731-734.

Dr. Ken Gilleo "Chip Scale or Flip Scale—the Wrong Question?" Cookson Electronics pp. 1-8.

Karnfelt, et al. "Flip Chip Assembly of a 40-60 GHz GaAs Microstrip Amplifier" Chalmers University of Technology, Microwave Electronics Laboratory Sweden.

(Continued)

*Primary Examiner*—Huedung Mancuso
(74) *Attorney, Agent, or Firm*—Nixon Peabody LLP; David B. Ritchie

(57) ABSTRACT

A full-wave di-patch antenna having two half-wave patch antennas located such that the feed points are facing one another and are brought out to a balanced transmission line having two conductors of microstrip feed lines. The phase of the current and the voltage is inverted 180 degrees between the two patches relative to the mechanical structure. The physical spacing of the two patches from center-to-center is one guide wavelength long. The two patches are disposed on a dielectric substrate which is in turn disposed over a ground plane. The two patches can take any of a number of shapes including a rectangle.

24 Claims, 3 Drawing Sheets

OTHER PUBLICATIONS

Staiculescu, et al. "Flip-Chip vs. Wirebond There's No Clear Winner Yet in the Microwave and Millimeter-Wave Arenas" Printed Circuit Design Jun. 2002 pp. 12-16.
Katarina Boustedt "GHz Flip Chip—An Overview" Ericsson Microwave Systems AB, Core Unit Research Center Microwave and High Speed Electronics Sweden.
Peter Bodo "Low Cost Interconnect, Packaging and Sub-system Integration Technologies for Millimetere-wave Applications" ist (information society technologies) Project No. 30128 Mar. 9, 2005.
Jentzsch, et al. "Theory and Measurements of Flip-Chip Interconnects for Frequencies up to 100 GHz" IEEE Transactions on Microwave Theory and Techniques, vol. 49 No. 5 May 2001 pp. 871-878.
Agarwal, et al. "A Transferred-Substrate HBT Wide-Band Differential Amplifier to 50 GHz" IEEE Microwave and Guided Wave Letters vol. 8 No. 7 Jul. 1998 pp. 263-265.
Viallon, et al. "Microwave Differential Structures Optimization: Application to a Double Balanced SiGe Active Down-Converter Design" IEEE International Workshop on Radio-Frequency Integration Technology Nov. 30-Dec. 2, 2006 Singapore.
Deal, et al. "Integrated-Antenna Push-Pull Power Amplifiers" IEEE Transactions on Microwave Theory and Techniques, vol. 47 No. 8 Aug. 1999 pp. 1418-1425.
Brauner, et al. "A Differential Active Patch Antenna Element for Array Applications" IEEE Microwave and Wireless Components Letters vol. 13 No. 4 Apr. 2003 pp. 161-163.
Hang, et al. "High-Efficiency Push-Pull Power Amplifier Integrated with Quasi-Yagi Antenna" IEEE Transactions on Microwave Theory and Techniques. vol. 49 No. 6 Jun. 2001.
Abele, et al. "Wafer Level Integration of a 24 GHz Differential SiGe-MMIC Oscillator with a Patch Antenna using BCB as a Dielectric Layer" IEEE European Microwave Conference vol. 33 Oct. 2003 pp. 293-296.
Pfeiffer, et al. "A 60GHz Radio Chipset Fully-Integrated in a Low-Cost Packaging Technology" IEEE Electronic Components and Technology Conference—2006 pp. 1343-1346.
Pfeiffer, et al. "A Chip-Scale Packaging Technology for 60-GHz Wireless Chipsets" IEEE Transactions on Microwave Theory and Techniques vol. 54 No. 8 Aug. 2006 pp. 3387-3397.
Pfeiffer, et al. "Equivalent Circuit Model Extraction of Flip-Chip Ball Interconnects Based on Direct Probing Techniques" IEEE Microwave and wireless Components Letters vol. 15 No. 9 Sep. 2005 pp. 594-596.
Ullrich R. Pfeiffer "Low-Loss Contact Pad with Tuned Impedance for Operation at Millimeter Wave Frequencies" IEEE SPI 2005 pp. 61-64.
Schrank, et al. "Analysis of the Radiation Resistance and Gain of a Full-Wave Dipole" IEEE Antennas and Propagation Magazine vol. 36, No. 5 Oct. 1994 pp. 45-47.
International Search Report and Written Opinion, Application No. PCT/US2008/004794, dated Jun. 19, 2008.

* cited by examiner

FULL-WAVE DI-PATCH ANTENNA

TECHNICAL FIELD

The subject matter described relates generally to a balanced feed antenna.

BACKGROUND

Over the years, many antenna forms have been developed and employed. As the signal wavelengths have gotten shorter and shorter, new antennas have been needed and developed. One example prior art antenna is demonstrated in FIG. 1 which shows a schematic diagram of a canonical half-wave microstrip patch antenna 10 with inset feed 12. Unfortunately, this is an unbalanced antenna form which may not be suitable for all applications.

OVERVIEW

A full-wave di-patch antenna having two half-wave patch antennas located such that the feed points are facing one another and are brought out to a balanced transmission line consisting of two conductors of microstrip feed lines is disclosed. The phase of the current and the voltage is inverted 180 degrees at the feedpoints between the two patch antennas relative to the mechanical structure. The physical spacing between the two patch antennas is about one guide wavelength in length from their respective centers. In an embodiment, the two patches are disposed on a dielectric substrate which is in turn disposed over a ground plane. The two patches can take any of a number of shapes including a rectangle.

BRIEF DESCRIPTION OF THE DRAWINGS

The accompanying drawings, which are incorporated into and constitute a part of this specification, illustrate one or more exemplary embodiments of the present invention and, together with the detailed description, serve to explain the principles and exemplary implementations of the invention.

In the drawings.

DESCRIPTION OF EXAMPLE EMBODIMENTS

Various example embodiments of the present invention are described herein in the context of a full-wave di-patch antenna. Those of ordinary skill in the art will realize that the following detailed description of the present invention is illustrative only and is not intended to be in any way limiting. Other embodiments of the present invention will readily suggest themselves to such skilled persons having the benefit of this disclosure. Reference will now be made in detail to exemplary implementations of the present invention as illustrated in the accompanying drawings. The same reference indicators will be used throughout the drawings and the following detailed descriptions to refer to the same or like parts.

In the interest of clarity, not all of the routine features of the exemplary implementations described herein are shown and described. It will of course, be appreciated that in the development of any such actual implementation, numerous implementation-specific decisions must be made in order to achieve the specific goals of the developer, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Figure 2:
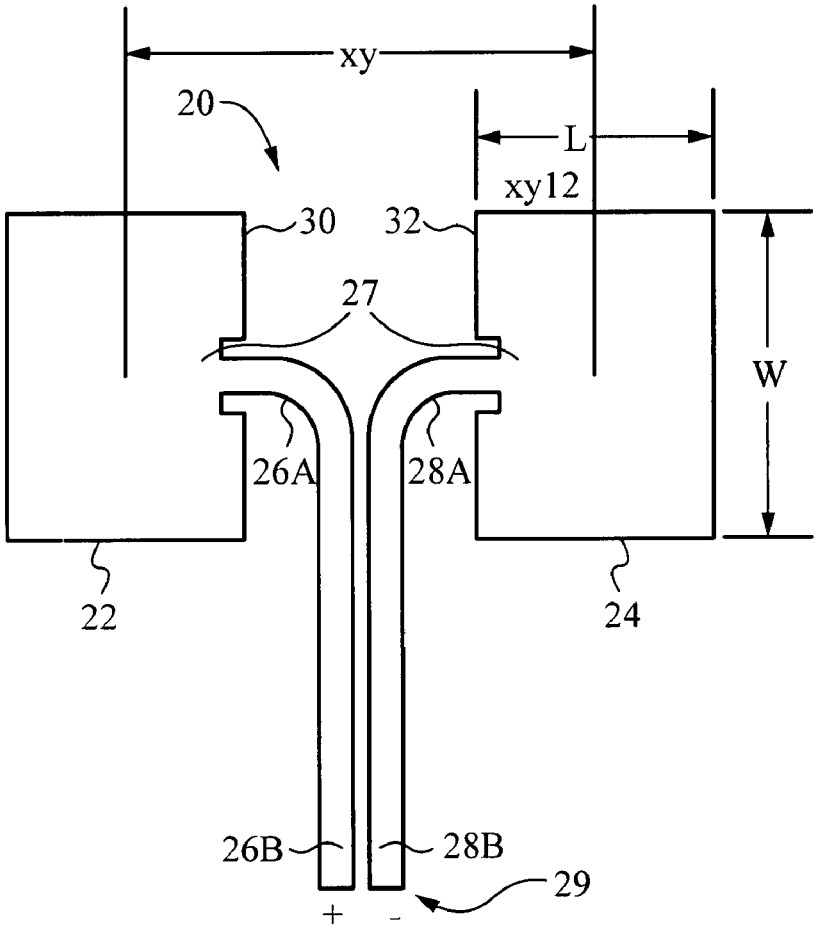
FIG. 2 illustrates a schematic wiring diagram of a full-wave di-patch antenna according to an embodiment.

FIG. 2 illustrates a schematic diagram of a full-wave di-patch antenna according to an embodiment. In an embodiment, the di-patch antenna 20 shown includes a first patch antenna 22 and a second patch antenna 24. The first and second patch antennas 22, 24 are each coupled to respective feed lines 26, 28. The patch antennas 22, 24 are shown to have a rectangular shape with dimensions (L×W), although the antennas 22, 24 may have any other appropriate shape.

In the case of the rectangular patch shape, the length (L) dimension of the antenna is a critical dimension in which the length dimension L is one-half of the guide wavelength, $\lambda_g$ in an embodiment. The guide wavelength $\lambda_g$ is a half wave length when taking into consideration the dielectric properties of the substrate 32 upon which the patch antenna 20 is disposed (FIG. 3) as well as other electromagnetic modes that may occur within the dielectric substrate. The $\lambda_g$ is affected by the relative permittivity ($\in_r$) and the thickness of the substrate, and the size of the substrate and groundplane relative to $\lambda$. It is analytically difficult to predict the exact value of L for a particular structure, but very good results are achieved by use of electromagnetic modeling programs. The width (W) dimension is less critical than the length dimension and can be a fraction or multiple of the L dimension. In an embodiment, the patch antennas 22, 24 are square-shaped, whereby the W dimension is equal to length ($\lambda_g/2$). In an embodiment, as shown in FIG. 2, the patch antennas 22, 24 have a rectangular shape wherein the W dimension is one and a half times the length dimension L. The spacing between the two patch antennas 22, 24, center-to-center as shown in FIG. 2, is twice the length dimension (2L) of the individual patch antennas in an embodiment.

Figure 6:
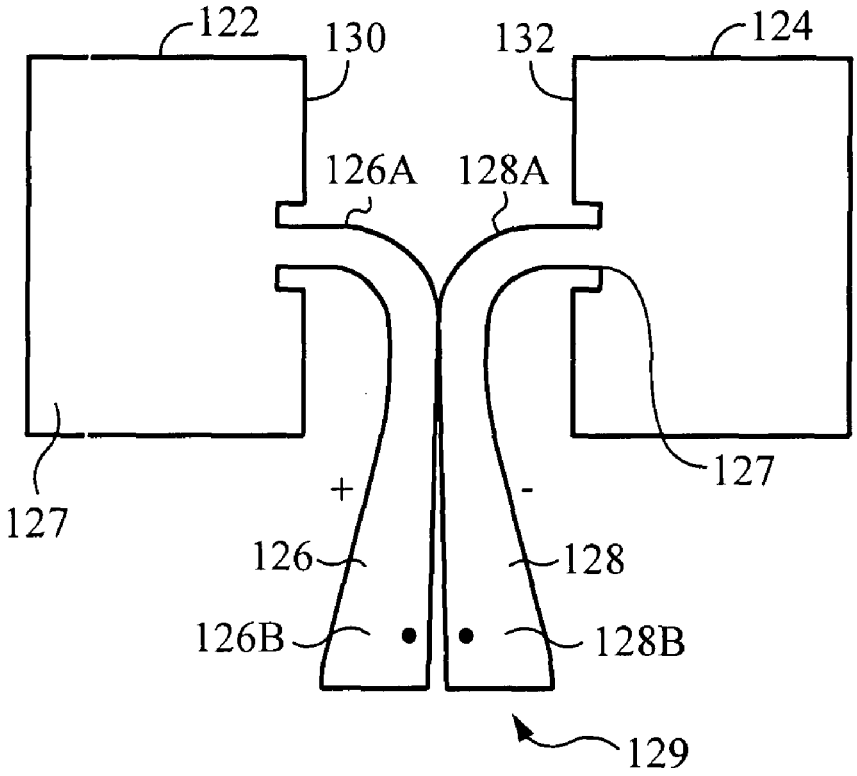
FIG. 6 illustrates a diagram of a full-wave di-patch antenna attached to a dielectric substrate and a ground plane according to an embodiment.

As shown in FIG. 2, two differential or balanced feed lines 26, 28 are coupled to the patch antennas 22, 24. In addition, the first feed line 26 is also coupled to a positive terminal of a differential feed point 29 at a distal end, whereas the second feed line 28 is coupled to a negative terminal of the differential feed point 29 at a distal end. It should be noted that the positive-negative terminals at 29 may be reversed in an embodiment. The feed lines 26, 28 are coupled to the inset feeds 27 at a proximal end, whereby the lines 26, 28 gradually curve at an angle (26A, 28A). The proximal ends of the feed lines 26, 28 are connected to the patch antennas at a center point with respect to the W dimension and are thus rotated ninety degrees relative to the parallel portions 26B, 28B. In an embodiment shown in FIGS. 2 and 3, following the angles at 26A, 28A, the feed lines 26, 28 then become parallel with one another toward their distal ends 26B, 28B. In an embodiment shown in FIG. 6, the feed lines 126, 128 are both parallel and taper outward at a slight angle. In other words, in the embodiment shown in FIG. 6, the feed lines are narrow at proximal locations 126A and 128B and widen in width dimension at the distal locations 126A and 126B. This particular configuration provides for matching impedance with different feed point spacing as shown in FIG. 6. It should be noted that other shapes of the feed lines are contemplated and are not limited to the embodiments only discussed herein.

As shown in FIG. 2, the patch antennas 22, 24 face away from one another and are positioned ninety degrees from and adjacent to the distal portion of the differential feed lines 26B, 28B. In particular, as shown in FIG. 2, the patch antenna 22 is positioned −90° with respect to the distal portion 26B of the differential feed line 26 whereas the patch antenna 24 is positioned +90° with respect to the distal portion 26B of the differential transmission line 28B.

In addition, the inset feeds 27 of each antenna 22, 24 are positioned to face one another and are at a closest distance with respect to one another. In contrast, the top edges opposite to the inset feed edges of the antennas 22, 24 are a farthest distance from one another.

Figure 1:
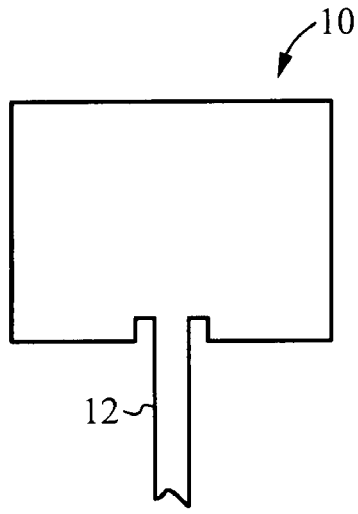
Fig. 1 (PRIOR ART)
FIG. 1 illustrates a schematic diagram of a canonical half-wave microstrip patch with inset feed.
Figure 3:
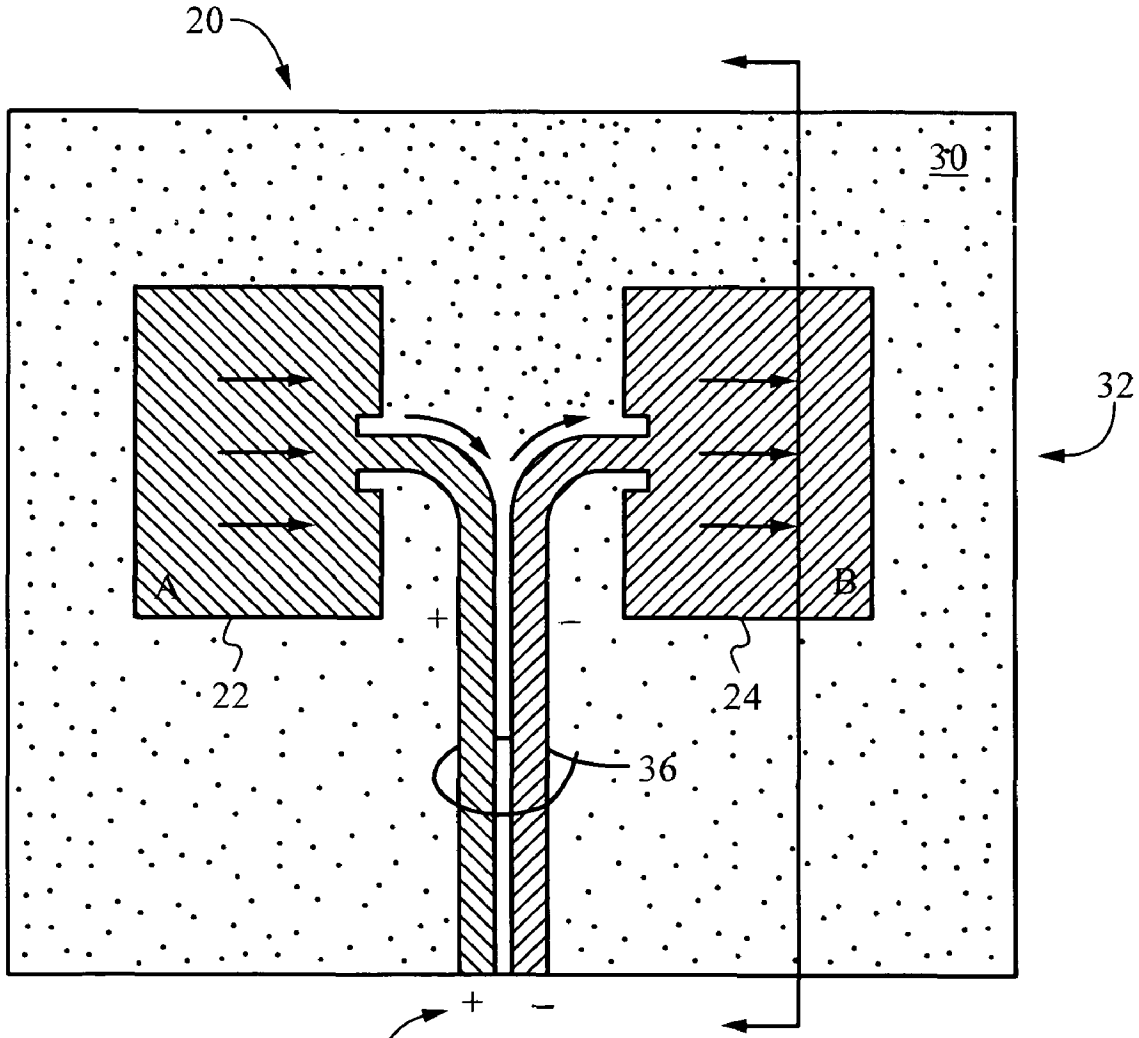
FIG. 3 illustrates a diagram of a full-wave di-patch antenna attached to a dielectric substrate and a ground plane according to an embodiment.

The two differential feed lines 26, 28 form a balanced transmission line in which the phase of the current and voltage is inverted 180 degrees between the left and right patch antennas 22, 24 in order to produce in-phase currents and voltages in the left and right patch elements. In other words, the currents in the transmission lines feeding the right and left patch antennas 22, 24 are 180 degrees out of phase with respect to one another, as shown in FIG. 3. However, the currents in the right and left patch antennas 22, 24 are in phase with one another collectively when both antennas 22, 24 are viewed with respect to an external reference. The design incorporates half-wave patch antenna structures in which there is a half-wave gap or $\lambda_g/2$ between the edges 30, 32 of the respective patch antennas 22, 24. This results in a full-wave $\lambda_g$ spacing between the centers of the patch antennas 22, 24 as described above. The radiation pattern phase center is located at the center point between the patch structures as illustrated. By use of the antenna structure shown, the need for a matching balun is eliminated. As a result, maximum energy transfer efficiency is attained. Further, the full-wave di-patch antenna 20 has higher directive gain than the half-wave microstrip patch 10 shown in FIG. 1.

Figure 4:
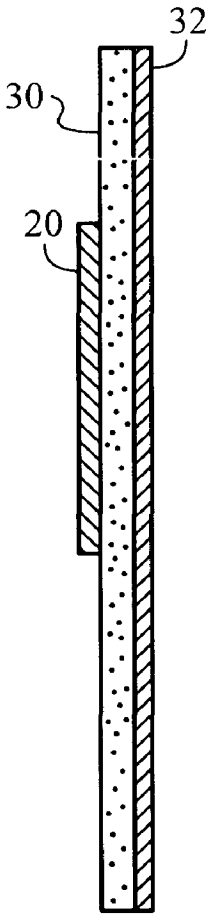
FIG. 4 illustrates a cross section view of the schematic of FIG. 3 according to the an embodiment.

FIG. 3 illustrates a diagram of an assembly of the full-wave di-patch antenna 20 disposed on a dielectric substrate 30 in accordance with an embodiment. FIG. 4 is a cross section view, along the line shown in FIG. 3, of the antenna assembly in FIG. 3. These drawings are not to scale and are only intended to show a general design of the various layers. A wide variety of actual implementations may be possible within the scope of the present invention. Those of ordinary skill in the art will recognize that the dielectric substrate 30 will likely be much thinner than shown. The dielectric substrate 30 is made of a low-loss material such as PTFE based composites, fused silica, ceramic materials, or the like.

As shown in FIG. 3, the angled configuration of the first and second patch antennas 22, 24 allow the currents flowing through both patch antennas 22, 24 to be in phase with one another, as shown by the arrows. In particular to FIG. 3, the current in the first patch antenna 22 flows from left to right, through the feed line 26 to the positive terminal of the feed point, as shown by the arrows. In addition, as shown in FIG. 3, the current travels from the negative terminal at the feed point upward and into the feed line inset in the second patch antenna 24, whereby the current flowing in the patch antenna 24 also travels left to right, as shown by the arrows. This configuration thus results in a single full-wave antenna structure composed of two elements with higher gain than a single patch antenna shown in FIG. 1 (approximately 9 dBi for the full-wave antenna compared to 7 dBi of a half wave antenna). In addition, this configuration provides maximum efficiency of the energy transfer to the full-wave antenna 22, 24 without requiring the use of a matching balun.

Figure 5:
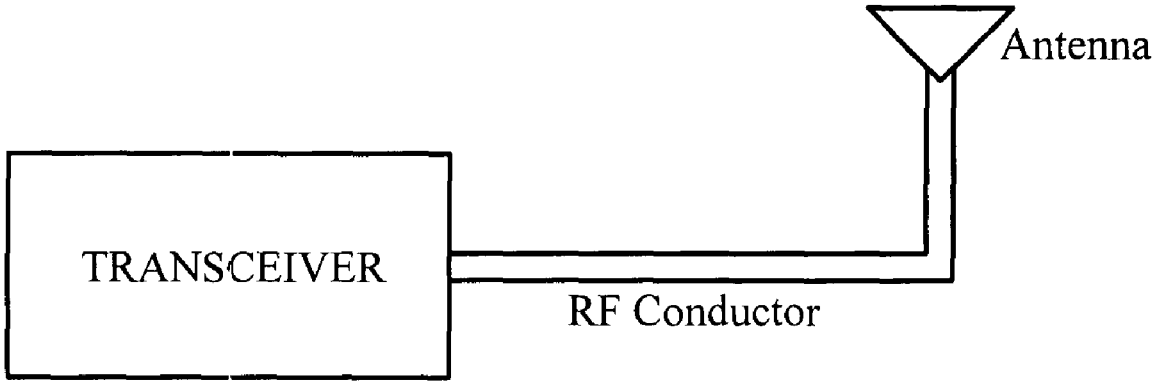
FIG. 5 illustrates a block diagram of a system incorporating the full-wave di-patch antenna according to an embodiment.

The antenna configurations described herein employ one or more full wave di-patch antennas, whereby the antenna configurations may be used in several applications. One example application may include millimeter wave transmitters, receivers, or transceivers using a balanced line feed (FIG. 5). Another example application may be a radar transceiver such as those used for vehicular collision avoidance (e.g. 77 GHz) as well as radio frequency identification (RFID), tracking and security systems (e.g. 60 GHz, 92 GHz and/or 120 GHz). Another example may include a passive millimeter wave detection system such as those that may be employed in airport security systems, industrial object tracking, through-the-wall detection systems (24 GHz, 60 GHz, and/or 92 GHz) and the like. A fourth example may be high speed digital communication systems for data links, wireless "no cable" links, high-definition video transport, and/or wireless local area networks using millimeter wave frequencies (60 GHz, 92 GHz, and/or 120 GHz). Those of ordinary skill in the art having the benefit of this disclosure will realize other applications may exist which can utilize the antenna configurations described herein. These configurations are scalable to frequencies up through millimeter and sub-millimeter ranges, including (but not limited to) the "sub terahertz" frequencies from 300 GHz through 1 THz.

In an embodiment, the patch antenna elements and transmission lines are formed onto a substrate by depositing metal onto the substrate known as a thin-film process, whereby various methods of thin film metal deposition may be used. In an embodiment, metal is deposited onto a substrate via chemical vapor deposition, sputtering or plating. In an embodiment, gold is deposited over a thin layer of chromium on a fused silica substrate to form the patch antennas. In an embodiment, the thickness of the antennas which are built up would be a substrate of 250 micrometers, with a chromium layer of 50 nanometers. This is followed by a gold layer of 3 micrometers. Other thicknesses and materials may be used and are dependent upon operating frequency and physical packaging constraints for a given application.

Although the antenna configurations are shown and described herein as having two antennas, it is contemplated that more than two antennas may be coupled to a pair of differential feed lines in an embodiment. It is also contemplated that multiple sets of patch antennas may be disposed on a substrate to increase the amount of gain produced and to provide phased array beam steering functionality by controlling the phases of the voltages and currents connected to the feed lines associated with each set of antenna elements. In one or more embodiments, multiple sets of antenna structures may be disposed side by side on the substrate. In one or more embodiments multiple sets of antenna structures are stacked on top of one another on the substrate to produce greater gain.

While embodiments and applications have been shown and described, it would be apparent to those skilled in the art having the benefit of this disclosure that many more modifications than mentioned above are possible without departing from the inventive concepts disclosed herein. The invention, therefore, is not to be restricted except in the spirit of the appended claims.

What is claimed is:

1. A full-wave di-patch antenna comprising:

a common differential feed point having a positive terminal and a negative terminal;

a differential feed line pair comprising a first feed line having a distal end coupled to the positive terminal and a second feed line having a distal end coupled to the negative terminal, wherein the first and second feed lines are adjacent to one another at the distal end;

a first patch antenna connected to a proximal end of the first feed line;

a second patch antenna connected to a proximal end of the second feed line, the first patch antenna and the second patch antenna are spaced a full guide wavelength apart, wherein the first and second patch antennas are configured to maximize energy transfer efficiency therebetween to operate as a single full-wave structure at millimeter wave frequencies.

2. The antenna of claim 1, further comprising a dielectric substrate upon which the patch antennas are disposed.

3. The antenna of claim 1, wherein current and voltage delivered to the feed points of the first and second patch antennas are 180 degrees out of phase with respect to one another individually and in phase with one another with respect to the antennas.

4. The antenna of claim 1, wherein the first and second feed lines are parallel with one another at the distal end.

5. The antenna of claim 1, wherein the first and second feed lines each have a first width dimension near the proximal end and a second width dimension near the distal end, wherein the second width dimension of each feed line is larger than the first width dimension.

6. The antenna of claim 1, wherein the first and second patch antennas are the full guide wavelength apart between centers of the first and second patch antennas.

7. The antenna of claim 1, wherein the first and second patches each have a shape of a rectangle.

8. The antenna of claim 1, wherein the first and second patch antennas are rectangular in shape, wherein a length dimension of each patch antenna is one-half a guide wavelength.

9. A full-wave di-patch antenna comprising:

a first patch antenna having a center feed inset along an edge, wherein the first patch antenna is rotated about ninety degrees in relation to a common differential feed point; and a second patch antenna separate from the first patch antenna by a full guide wavelength, the second patch antenna having a center feed inset along an edge, the second patch antenna is rotated about ninety degrees in relation to the differential common feed point, wherein the center inset feeds to first patch antenna and the second patch antenna are rotationally oriented 180 degrees away from one another with respect to the common feed point, wherein the first and second patch antennas operate at millimeter wave frequencies.

10. The antenna of claim 9, further comprising a dielectric substrate upon which the patch antennas are disposed.

11. The antenna of claim 9, wherein current and voltage delivered to the feed points of the first and second patch antennas are 180 degrees out of phase with respect to one another individually and 180 degrees in phase with one another with respect to the antennas.

12. The antenna of claim 9, wherein the first and second patch antennas are the full guide wavelength apart between centers of the first and second patch antennas.

13. The antenna of claim 9, wherein the first and second patches each have a shape of a rectangle.

14. The antenna of claim 9, wherein the first and second patch antennas are rectangular in shape, wherein a length dimension of each patch antenna is one-half a guide wavelength.

15. The antenna of claim 9, wherein the first and second feed lines are parallel with one another at the distal end.

16. The antenna of claim 9, wherein the first and second feed lines each have a first width dimension near the proximal end and a second width dimension near the distal end, wherein the second width dimension of each feed line is larger than the first width dimension.

17. A full-wave di-patch antenna comprising:

a common differential feed point having a positive terminal and a negative terminal;

a differential feed line pair comprising a first feed line having a distal end coupled to the positive terminal and a second feed line having a distal end coupled to the negative terminal, wherein the first and second feed lines are adjacent to one another at the distal end;

a first patch antenna having a first feed inset connected to a proximal end of the first feed line at a center of an edge, wherein the first feed inset is oriented approximately 90 degrees in a first direction with respect to the distal end of the first feed line; and a second patch antenna separate from the first patch antenna, the second patch antenna having a second feed inset connected to a proximal end of the second feed line at a center of an edge, wherein the second feed inset is oriented approximately 90 degrees in a second direction with respect to the distal end of the second feed line and opposite to the first direction and 180 degrees with the first feed inset, wherein the first and second patch antennas operate at millimeter wave frequencies.

18. The antenna of claim 17, further comprising a dielectric substrate upon which the patch antennas are disposed.

19. The antenna of claim 17, wherein current and voltage delivered to the feed points of the first and second patch antennas are 180 degrees out of phase with respect to one another individually and 180 degrees in phase with one another with respect to the antennas.

20. The antenna of claim 17, wherein the first and second patch antennas are the full guide wavelength apart between centers of the first and second patch antennas.

21. The antenna of claim 17, wherein the first and second patches each have a shape of a rectangle.

22. The antenna of claim 17, wherein the first and second patch antennas are rectangular in shape, wherein a length dimension of each patch antenna is one-half a guide wavelength.

23. The antenna of claim 17, wherein the first and second feed lines are parallel with one another at the distal end.

24. The antenna of claim 17, wherein the first and second feed lines each have a first width dimension near the proximal end and a second width dimension near the distal end, wherein the second width dimension of each feed line is larger than the first width dimension.

* * * * *